US008397895B2

(12) United States Patent
Yokota

(10) Patent No.: US 8,397,895 B2
(45) Date of Patent: Mar. 19, 2013

(54) BANKNOTE HANDLING APPARATUS

(75) Inventor: Yasushi Yokota, Hyogo (JP)

(73) Assignee: Glory Ltd., Hyogo (JP)

( * ) Notice: Subject to any disclaimer, the term of this patent is extended or adjusted under 35 U.S.C. 154(b) by 246 days.

(21) Appl. No.: 12/919,661

(22) PCT Filed: Feb. 27, 2008

(86) PCT No.: PCT/JP2008/053425

§ 371 (c)(1),
(2), (4) Date: Aug. 26, 2010

(87) PCT Pub. No.: WO2009/107207

PCT Pub. Date: Sep. 3, 2009

(65) Prior Publication Data

US 2010/0326789 A1 Dec. 30, 2010

(51) Int. Cl.
*G07F 7/04* (2006.01)
*B65B 13/02* (2006.01)

(52) U.S. Cl. ..... 194/206; 53/399

(58) Field of Classification Search ..... 194/206, 194/353; 53/399, 414; 270/52.02, 52.18, 270/58.01, 58.07, 58.08; 902/36
See application file for complete search history.

(56) References Cited

U.S. PATENT DOCUMENTS

| | | | | |
|---|---|---|---|---|
| 7,367,169 | B2 | 5/2008 | Katsumata | |
| 2005/0060956 | A1 | 3/2005 | Yui | |
| 2006/0076212 | A1 | 4/2006 | Kuroda et al. | |
| 2006/0157390 | A1 * | 7/2006 | Otsuka | 209/534 |

FOREIGN PATENT DOCUMENTS

| | | | |
|---|---|---|---|
| JP | 57-065468 U | | 4/1982 |
| JP | 64-7415 | | 2/1989 |
| JP | 11-120412 A | | 4/1999 |
| JP | 11120412 A | * | 4/1999 |
| JP | 2004-262457 A | | 9/2004 |
| JP | 2005-96896 | | 4/2005 |
| JP | 2006-107212 A | | 4/2006 |

* cited by examiner

*Primary Examiner* — Mark Beauchaine
(74) *Attorney, Agent, or Firm* — Rabin & Berdo, P.C.

(57) ABSTRACT

A banknote handling apparatus 1 of the present invention includes: a recognition unit 6 for recognizing a kind of banknote; a stacking unit 32 to 36 for stacking a banknote of a predetermined kind recognized by the recognition unit 6; and a bundling unit 51 for bundling the banknotes stacked by the stacking units 32 to 36. The bundling unit 51 includes a tape setting unit 80 for setting a plurality of reeled tapes 52 and 53; a bundling mechanism 54 for bundling the stacked banknotes by using tape T1 or T2 pulled out from any one of the reeled tape 52 or 53 set in the tape setting unit 80; and a tape switching unit 96 for switching the tape T1 or T1 to be fed from the tape setting unit 80 in correspondence to the kind of banknotes recognized by the recognition unit 6.

12 Claims, 8 Drawing Sheets

(1)

(2)

BANKNOTE HANDLING APPARATUS

TECHNICAL FIELD

The present invention relates to a banknote handling apparatus having a mechanism for stacking a predetermined number of banknotes and bundling the stacked banknotes, and more particularly, relates to a banknote handling apparatus capable of selectively using a plurality of kinds of tapes so as to bundle banknotes.

BACKGROUND ART

In financial institutions, for example, a banknote handling apparatus for arranging collected banknotes, etc., is used. This type of banknote handling apparatus receives the collected banknotes from an inlet into the apparatus, determines the kinds of banknotes, and stacks the banknotes depending on each kind. Each kinds (denominations) of stacked banknotes are transported to a bundling device to be bundled by every 100 sheets unit into a bundle of banknotes (100 sheets of stacked banknotes) by using a tape.

In the conventional banknote handling apparatus, generally, only one kind of tape is disposed in the apparatus for bundling the banknotes (see Patent Document 1 below, for example).

There are countries, however, where it is regulated that when collected banknotes are bundled, a color of a bundling tape should be changed by denomination. As a conventional apparatus to comply with such regulations, Patent Document 2 below discloses a banknote bundling processor in which a white tape is used, and a color corresponding to the denomination is printed on the tape, when the denomination of the banknotes to be bundled is changed, and the banknotes are bundled with a printed tape.

In the above-described apparatus, a color is printed on the white tape by using an ink jet printer during the bundling, and thus, it is possible to bundle the banknotes with a tape of a different color by denomination. However, the tape is printed during a bundling process, and thus, many kinds of inks need to be stored within the apparatus. Moreover, it takes considerable time and effort to refill the inks. As a result, there is a problem that the cost to refill the inks is increased.

Moreover, Patent Document 3 below discloses a paper sheet handling apparatus in which two ribbon rolls are arranged in the apparatus, when the remaining amount of one of the two ribbon rolls is decreased, the entire two ribbon rolls are rotated, and the ribbons are automatically replaced so that the ribbon is supplied from the other ribbon roll. The apparatus disclosed in this publication has two ribbon rolls. It is, however, not possible to select, for each bundling process, one of the two ribbon rolls and feed the ribbon from the selected ribbon roll. Moreover, during replacement of the ribbon rolls, the entire two ribbon rolls are rotated. Thus, the mechanism requires a relatively large space, resulting in an increase in size, which is a problem.

Patent Document 1: Japanese Published Unexamined Patent Application 2006-107212

Patent Document 2: Japanese Published Unexamined Patent Application 2004-262457

Patent Document 3: Japanese Published Unexamined Patent Application H11-120412

DISCLOSURE OF THE INVENTION

Problem to be Solved by the Invention

The present invention has been achieved based on the above-described background art, and a primary object thereof is to provide a banknote handling apparatus capable of stacking collected banknotes after sorting by denomination and bundling the banknotes with different kinds of tapes by denomination when bundling a predetermined number of banknotes.

Another object of the present invention is to provide a banknote handling apparatus that is provided with a tape setting unit in which a plurality of reeled tapes are set and that is capable of easily switching, according to the kind of banknotes, tapes to be fed.

Moreover, still another object of the present invention is to provide a banknote handling apparatus capable of switching tapes to be fed from a plurality of reeled tapes by using a simple mechanism that consumes less space.

Means for Solving the Problem

A banknote handling apparatus (1) of the present invention includes: a recognition unit (6) arranged to recognize a kind of banknote; a stacking unit (32 to 36) arranged to stack a banknote of a predetermined kind recognized by the recognition unit; and a bundling unit (51) arranged to bundle the banknotes stacked by the stacking unit. The bundling unit (51) comprises: a tape setting unit (80) arranged to set a plurality of reeled tapes; a bundling mechanism (54) for bundling the stacked banknotes by using a tape pulled out from any one of the reeled tapes set in the tape setting unit; and a tape switching unit (96, 102) arranged to switch the tapes fed to the bundling mechanism from the tape setting unit in correspondence to the kind of banknotes recognized by the recognition unit.

In addition, in this section, alpha-numerals in parentheses indicate reference numerals of the corresponding components in the embodiments described below. The reference numerals, however, will not limit the scope of the present invention.

According to the above-described configuration, in the tape setting unit (80), the plurality of reeled tapes (52, 53, 103 to 106) are set, and the tapes are switched by the tape switching unit (96, 102) so that the tape is fed to the bundling mechanism (54) from any one of the set reeled tapes. Therefore, it is possible to bundle the banknotes by using the tape according to the kind (denomination) of stacked banknotes.

In order to switch the tapes according to the kind of banknotes recognized by the recognition unit, the tape switching unit (96, 102) can switch the tapes at the appropriate timing for each time according to the kind of banknotes arranged by the banknote handling apparatus.

Moreover, the banknote handling apparatus (1) of the present invention may be configured so that the tape switching unit includes: a plurality of tape-feeding mechanisms (86, 92, 108 to 111) arranged for the respective reeled tapes set in the tape setting unit; and a shift mechanism (95, 96) for integrally sliding and moving the plurality of tape-feeding mechanisms so that anyone of the tape-feeding mechanisms faces the bundling mechanism.

According to the above-described configuration, the tape-feeding mechanisms (86, 92, 108 to 111) are provided for the respective reeled tapes, and when the plurality of tape-feeding mechanisms are integrally slid and moved by the shift mechanism (95, 96), one tape can be supplied to the bundling mechanism. Thus, the tape switching unit can be relatively easily configured and the space area occupied by the tape switching unit can be reduced.

Moreover, the plurality of tape-feeding mechanisms are integrally slid and moved by the shift mechanism, and thus, any of the tape-feeding mechanisms can be arbitrarily made to face the bundling mechanism. As a result, it is possible to reliably switch the tapes.

Further, in the present invention, each of the plurality of tape-feeding mechanisms may include a diversion path (85, 91) along which a feeding direction of the tape fed from the reeled tape is diverted by substantially 90 degrees.

According to the above-described configuration, each of the plurality of tape-feeding mechanisms arranged for each reeled tape has a diversion path (85, 91) for diverting the tape feeding direction by substantially 90 degrees. Thus, when only the tape-feeding mechanisms (86, 92) are slid and moved while the reeled tapes are retained in a fixed state, the tape-feeding mechanisms can be made to face the bundling mechanism and a desired tape can be fed to the bundling mechanism. In other words, because of the configuration in which the plurality of tape-feeding mechanisms are slid and moved integrally while the plurality of reeled tapes are retained in a fixed state, the tape switching unit can be further reduced in size and the tape switching unit can be assembled in a small occupied space. As a result, the apparatus will not become large.

In the present invention, the shift mechanism (102) may integrally slide the tape setting unit and the plurality of tape-feeding mechanisms.

According to the above-described configuration, the shift mechanism integrally slides the tape setting unit and the tape-feeding mechanisms, and thus, it is possible to reliably switch the tapes by using a simple mechanism of slide movement. Moreover, the slide movement is performed along a wall surface such as a bottom surface and a side surface within the apparatus, and thus, the space area occupied by the shift mechanism can be reduced in size, and a smaller apparatus can be realized.

In the banknote handling apparatus of the present invention, a plurality of reeled tapes of the same kind are set in the tape setting unit (80) to bundle the predetermined kind of banknotes, out of the banknotes to be bundled by the bundling unit.

According to the above-described configuration, even when the amount of tapes to be used for bundling the stacked banknotes is large corresponding to a large amount of banknotes, etc., which are collected more frequently than any other banknotes, a maintenance process such as replenishing a tape can be reduced, resulting in a banknote handling apparatus that is easy to use.

Further, in the banknote handling apparatus of the present invention, it is desired that the tape for bundling the predetermined kind of banknotes is always positioned to be fed to the bundling mechanism.

According to the above-described configuration, the predetermined reeled tape, out of the reeled tapes, is always positioned at a home position. Thus, when the frequently used tape is placed at the home position, it is possible to achieve a banknote handling apparatus which can conduct a bundling process promptly and smoothly.

DESCRIPTION OF REFERENCE NUMERALS

Figure 1A:
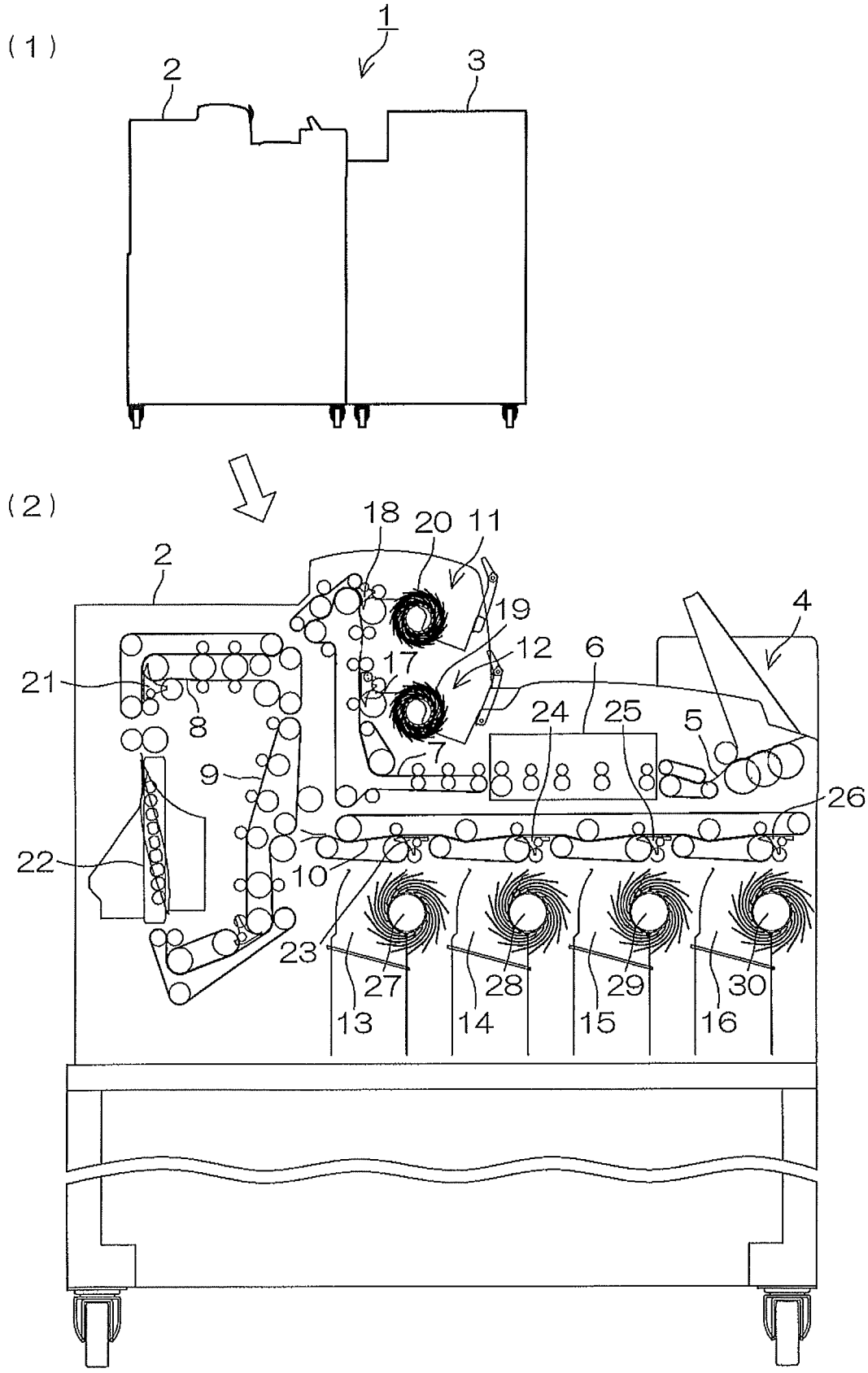
FIG. 1A An illustrative vertical cross sectional structural view showing the whole configuration of a banknote handling apparatus according to one embodiment of the present invention.

1 Banknote handling apparatus
6 Recognition unit
32, 33, 34, 35, 36 Stacking unit (stacking unit)
51 Bundling device (bundling unit)
52, 53, 103 to 106 Reeled tape
54 Bundling mechanism
85, 91 Diversion path
86, 92, 108 to 111 Tape-feeding mechanism
95, 96, 102 Shift mechanism

BEST MODE FOR CARRYING OUT THE INVENTION

Below, with reference to the drawings, embodiments of the present invention will be specifically explained.

<Description of Overview of Whole Configuration>

Figure 1B:
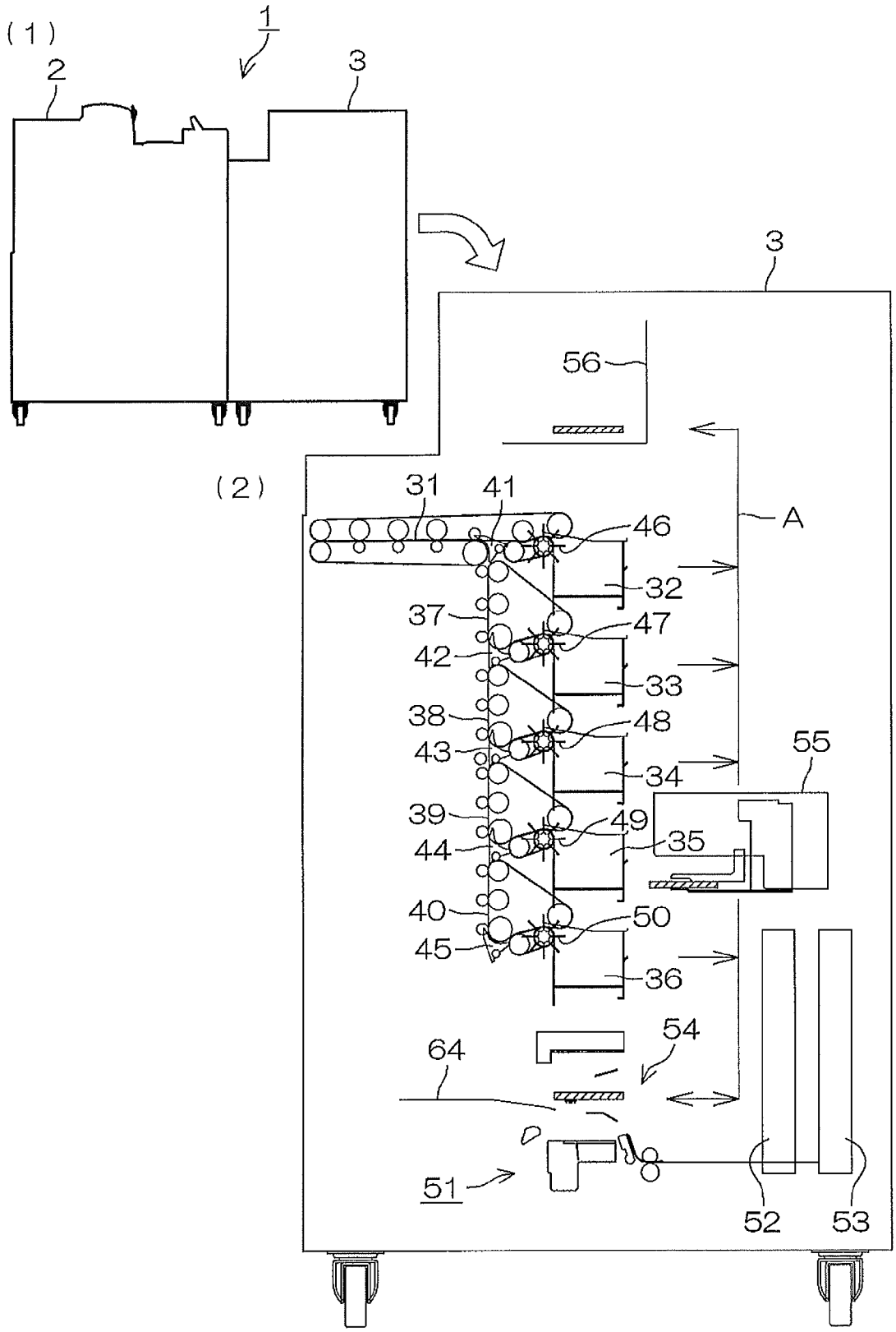
FIG. 1B An illustrative vertical cross sectional structural view showing the whole configuration of the banknote handling apparatus according to one embodiment of the present invention.

FIG. 1A and FIG. 1B are illustrative front vertical cross sectional views showing the whole configuration of a banknote handling apparatus 1 according to one embodiment of the present invention.

As shown in FIG. 1A(1) and FIG. 1B(1), the banknote handling apparatus 1 is, as can be seen, configured so that two housings 2 and 3 are linked.

First, with reference to FIG. 1A(2), the first housing 2 is provided with a banknote receiving unit, i.e., a hopper 4. Moreover, the first housing 2 is provided with: a receiving path 5 for receiving banknotes set at the hopper 4; a recognition unit 6 for recognizing a denomination, fit/unfit, genuine/counterfeit, face/back, etc., of the banknotes to be received; transport paths 7, 8, 9, and 10 for transporting the banknotes recognized by the recognition unit 6; two rejected-banknote stacking units 11 and 12; and four stacking units 13, 14, 15, and 16.

Along the transport path 7 for transporting the banknotes that have been recognized by the recognition unit 6, two diverters 17 and 18 are provided. When the diverters 17 and are switched, the banknotes can be stacked in the rejected-banknote stacking units 11 and 12. The rejected banknotes refer to those determined by the recognition unit 6 as unfit notes (notes that are greatly damaged due to contamination or being torn) or counterfeit notes, etc. These rejected banknotes are distinguished from those collected and reused, and are stacked in the rejected-banknote stacking units 11 and 12. In each of the rejected-banknote stacking units 11 and 12, stacking wheels 19 and 20 for accepting and stacking the transported rejected banknotes one by one are provided.

The banknotes other than the rejected banknotes are transported from the transport path 7 to the transport path 8. Along the transport path 8, a diverter 21 is provided. When the diverter 21 is switched, transporting a banknote directly to the transport path 9 or transporting to the transport path 9 via a reverse path 22 is enabled. The reverse path 22 is arranged for reversing the face/back of a banknote. The face/back of a banknote is reversed when the banknotes passes through the reverse path 22.

The transport path 9 transports the banknotes to the transport path 10 while adjusting a transport time and a timing so that the order of the banknotes directly transported from the transport path 8 and the banknotes transported via the reverse path 22 is not changed.

The transport path 10 extends in a substantially horizontal direction, for example, and below the path 10, the four stacking units 13, 14, 15, and 16 are arranged in line. When the four diverters 23, 24, 25, and 26 provided along the transport path 10 are switched, the banknotes can be stacked into any one of the stacking units 13 to 16. In the respective stacking units 13 to 16, the stacking wheels 27, 28, 29, and for accepting and stacking the banknotes one by one transported from the transport path 10 are provided, respectively.

Along the transport path 10, by controlling the switching of the diverters 23 to 26, the banknotes can be transported to a transport path 31 provided in the adjacent housing 3.

Next, with reference to FIG. 1B(2), in the housing 3, five stacking units 32, 33, 34, 35, and 36 are arranged in line in a vertical direction, for example. Transport paths 37, 38, 39, and 40 are provided for stacking the banknotes in any selected one of the five stacking units 32 to 36.

When the diverter 41 on the transport path 31 is switched, whether to stack the banknotes in the stacking unit 32 or to transport them to the transport path 37 is switched. When the diverter 42 is switched, whether to stack the banknotes in the stacking unit 33 or to transport them to the transport path 38 can be switched on the transport path 37. When the diverter 43 is switched, whether to stack the banknotes in the stacking unit 34 or to transport them to the transport path 39 can be switched on the transport path 38. When the diverter 44 is switched, whether to stack the banknotes in the stacking unit 35 or to transport them to the transport path 40 can be switched on the transport path 39. The diverter 45 on the transport path 40 is fixed in this embodiment, and guides the banknotes toward the stacking unit 36. Each of the transport paths 31, 37 to 40, fin wheels 46, 47, 48, 49, and 50 are provided so as to face the entrance of the stacking units 32 to 36. The fin wheels 46 to 50 promptly stack the banknotes by patting down from above on the rear end of the banknotes, which have been transported from the transport paths 31, 37 to 40 to the stacking units 32 to 36, and which tend to drop by their own weight. The banknotes are pressed down from above, one by one, by the fin wheels 46 to 50 to be stacked in the stacking units 32 to 36.

At a lower location within the housing 3, for example, a bundling device 51 is provided. The bundling device 51 has a plurality (two, for example) of reeled tapes 52 and 53 and a bundling mechanism 54. The bundling device 51 is for selectively feeding the tape from the reeled tapes 52 and 53 and for bundling the banknotes stacked by the bundling mechanism 54 with the tape.

Within the housing 3, a transport device 55 is further provided. The device 55 extracts the banknotes stacked in the stacking units 32 to 36, transports them to the bundling device 51, and carries a bundle of banknotes bundled with the tape by the bundling device 51 to outside the housing 3. Moreover, the device 55 is capable of carrying (in a case where a process is ended before the number of banknotes stacked in the stacking units 32 to 36 reach 100 sheets) the banknotes to a banknote returning unit 56 arranged at an upper location of the housing 3. The transport device 55 may move as indicated by an arrow A.

As explained above, out of the collected banknotes fed from an inlet 4, the banknote handling apparatus 1 stacks the rejected banknotes in the rejected-banknote stacking units 11 and 12. At the same time, the apparatus 1 can, for example, sort the banknotes to be reused by denomination, stack them (as loose banknotes) in the stacking units 13 to 16 or bundle the stacked banknotes of a predetermined number, which have been stacked in the stacking units 32 to 36 by denomination, by using the bundling device 51, and arrange them into a bundle of banknotes.

<Description for Operation of the Bundling Mechanism>

Subsequently, a series of operations for bundling the banknotes transported from the transport device 55 with a tape by using the bundling mechanism 54 will be explained with reference to FIG. 2A and FIG. 2B.

Figure 2A:
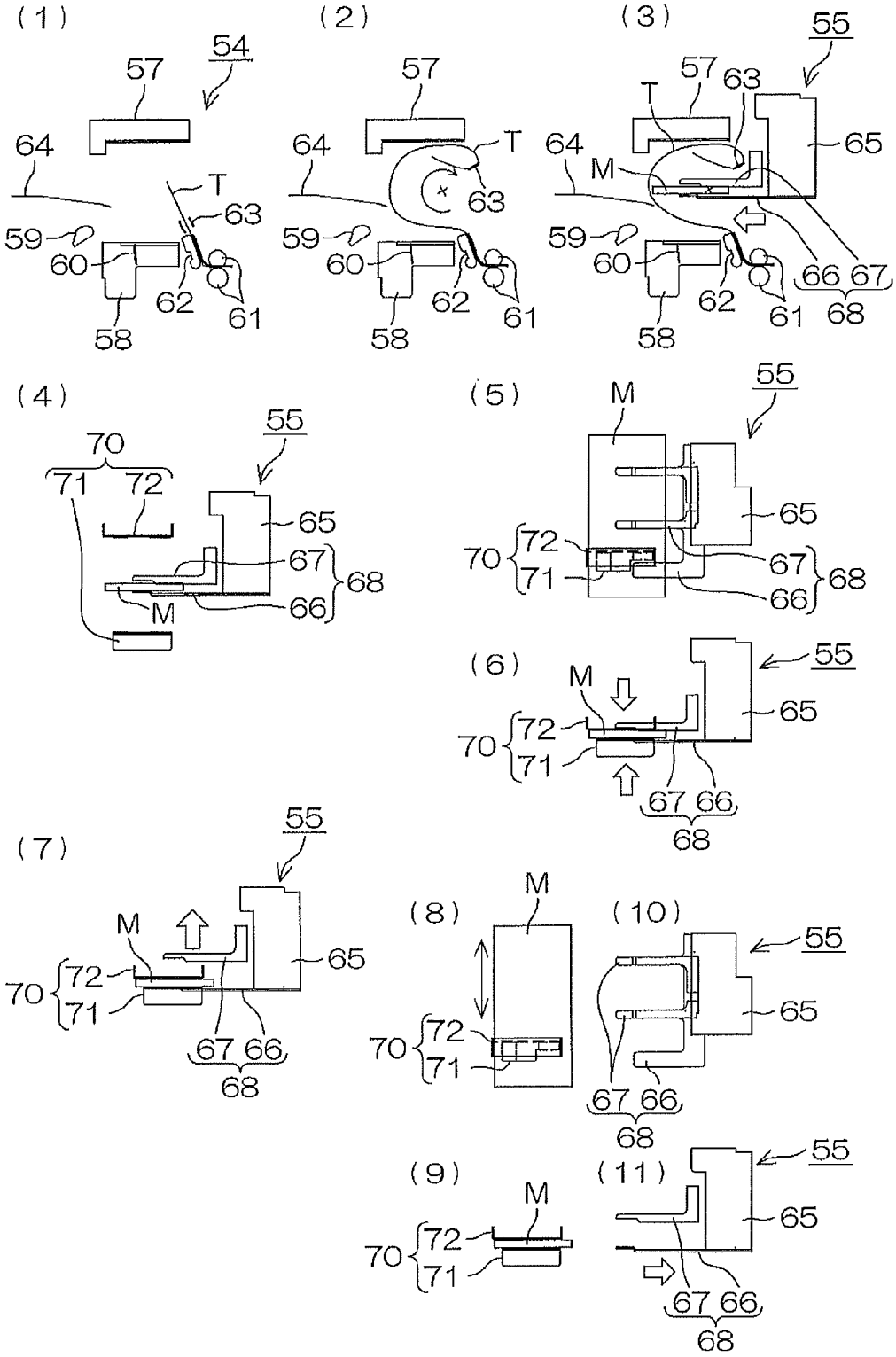
FIG. 2A An operation explanatory view for describing a bundling operation in a bundling mechanism provided in the banknote handling apparatus according to one embodiment of the present invention.

In the bundling mechanism 54, an upper clamp arm 57; a lower clamp arm 58; a heater 59; a cutter 60; a tape-forwarding roller pair 61; a forward guide 62; a holder 63 for holding the tape; and a bundle forward guide 64 are provided (FIG. 2A(1)). Although each component is illustrated in a floating state for convenience, in an actual mechanism, it is held by an arm, a shaft, etc., extending from a side-surface wall, etc.

Moreover, although not illustrated in FIG. 2A(1), the bundling mechanism 54 is provided with a bundling hand for holding the stacked banknotes. The bundling hand will be described later.

A tape T is fed by the roller pair 61, an area near a leading end of the tape T is sandwiched by the holder 63, and the holder 63 is circularly moved along a predetermined moving trail while the roller pair 61 sends forth the tape T. As a result, the tape T is sent forth clockwise in the form of a semi-circular arc. Thus, the bundling mechanism 54 gets ready for accommodating the stacked banknotes (FIG. 2A(2)).

To the bundling mechanism 54 that has become ready for accommodating the banknotes, the transport device 55 transports the stacked banknotes M, which are being grasped by the transport device 55 (FIG. 2A(3)). The transport device 55 includes: a base block 65; a lower fork 66 protruding substantially horizontally from the lower end of the base block 65; an upper fork 67 for pressing which is vertically movable from above, toward and away from the lower fork 66. The lower fork 66 and the upper fork 67 function as a transporting hand 68. The stacked banknotes M are sandwiched and held from below and above by the lower fork 66 and the upper fork 67, and transported to the bundling mechanism 54.

The bundling mechanism 54 includes a bundling hand 70 for receiving the stacked banknotes M transported by the transport device 55 from the transporting hand 68, as briefly explained with reference to FIG. 2A(1). FIG. 2A(4) shows a positional relationship between: the bundling hand 70; and the transporting hand 68 of the transport device 55. The transport device 55 shown in FIG. 2A(4) is stopped at the same position as that of the transport device 55 shown in FIG. 2A(3). In FIG. 2A(4), illustrations of the upper clamp arm 57, the lower clamp arm 58, the heater 59, the cutter 60, the roller pair 61, the holder 63, etc., are omitted. In FIGS. 2A(1) to 2A(3), the omitted bundling hand 70 is only shown. Moreover, FIG. 2A(5) is a plan view showing a positional relationship between the transport device 55 and the bundling hand 70, and FIG. 2A(6) is a front view of a state where the bundling hand 70 is closed.

The bundling hand 70 includes a receiving member 71 positioned below and a pressing member 72 positioned above. The receiving member 71 and the pressing member 72 can move upwardly and downwardly in close proximity relative to each other. As shown in FIGS. 2A(5) and (6), these members 71 and 72 can hold sides (as seen from a lengthwise direction) of the stacked banknotes M held by the transporting hand 68. Then, after the bundling hand 70 holds the stacked banknotes M, the upper fork 67 of the transporting hand 68 moves upwardly (FIG. 2A(7)) and the transport device 55 moves to the right side in the drawing. As a result, handing over the stacked banknotes M from the transporting hand 68 to the bundling hand 70 is completed.

The bundling hand 70 can also move in a horizontal back-and-forth direction. When the bundling hand 70 moves in the back-and-forth direction, the position of the stacked banknotes M within the bundling mechanism 54 can be displaced in the back-and-forth direction, enabling the adjustment of the position when the stacked banknotes M are bundled with the tape T.

Subsequently, with reference to FIG. 2B, a series of process operations for bundling the stacked banknotes M with the tape T will be explained. In addition, in FIG. 2B, the illustration of the bundling hand 70 holding the stacked banknotes M is omitted. However, the stacked banknotes M are held by the bundling hand 70 at a fixed position during the bundling operation.

Figure 2B:
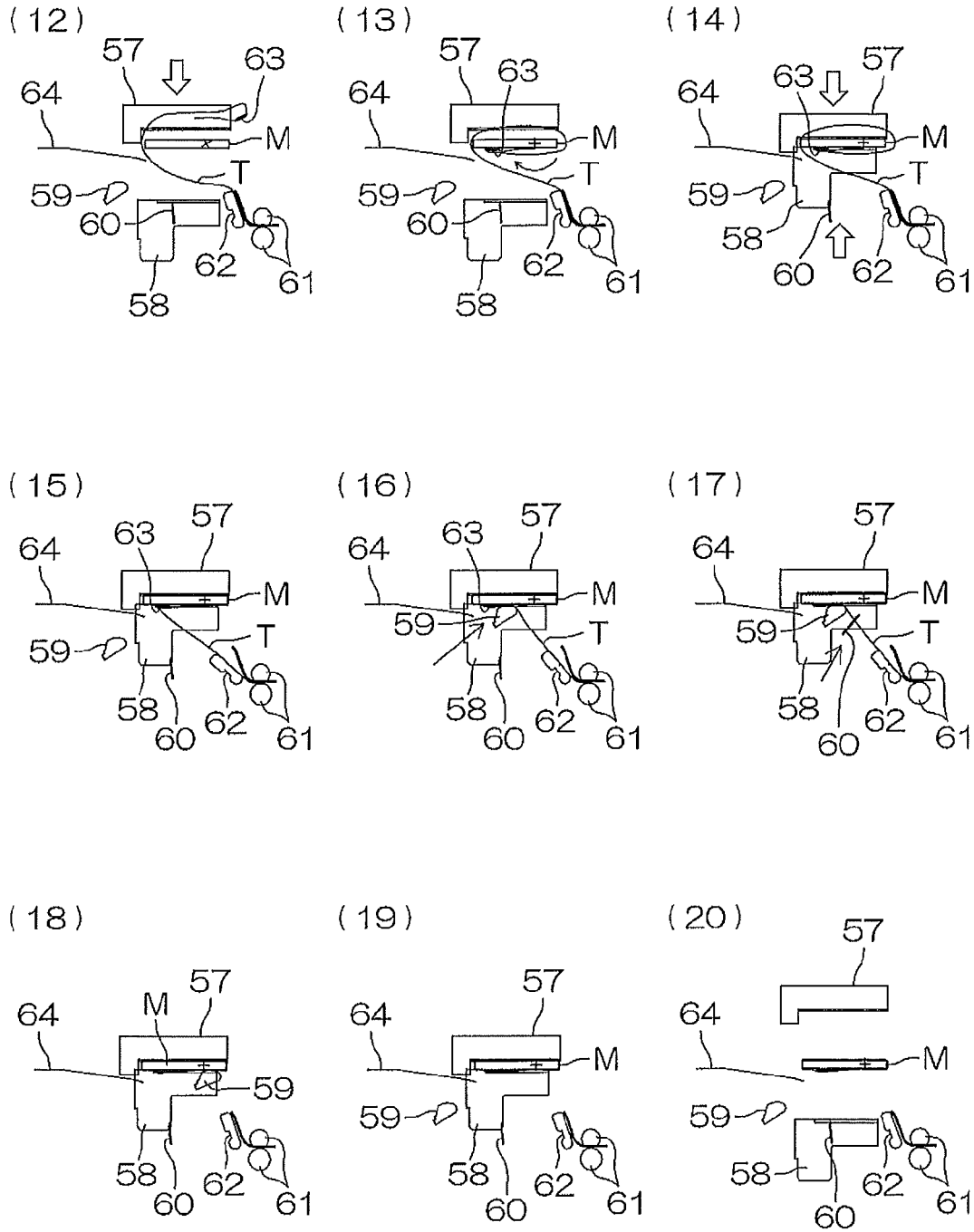
FIG. 2B An operation explanatory view for describing the bundling operation in the bundling mechanism provided in the banknote handling apparatus according to one embodiment of the present invention.

First, the upper clamp arm 57 is displaced downwardly and the tape T is arranged properly so that the position of the tape T does not deviate (FIG. 2B((12)). In a lower surface of the upper clamp arm 57, a tape guide groove (not shown) concave upward is formed at a predetermined position in the back-and-forth direction, and the tape is arranged properly by entering the guide groove.

Then, in this state, the holder 63 moves circularly, and as a result, the tape T is wound around the stacked banknotes M (FIG. 2B(13)).

When the winding of the tape T is ended, the upper clamp arm 57 and the lower clamp arm 58 move in close proximity relative to each other. As a result, the stacked banknotes M are fixed by being sandwiched from above and below by the upper and lower clamp arms 57 and 58 (FIG. 2B(14)). In the lower clamp arm 58, the tape guide groove is also formed at a predetermined position in the back-and-forth direction, and also in a state where the stacked banknotes M are sandwiched from above and below by the upper and lower clamp arms 57 and 58, the tape T is loosened in its lengthwise direction. Therefore, the roller pair 61 is reversed to pull back the tape T so that the tape T wound around the stacked banknotes M is tightened (FIG. 2B(15)).

Then, the heater 59 is operated to heat the tape T (FIG. 2B(16)). The tape T is a heat seal tape. Thus, when it is heated by the heater 59, overlapped portions of the tape are stuck together.

Subsequently, the cutter 60 is displaced to cut the tape T extending from the roller pair 61 in a direction of the stacked banknotes M (FIG. 2B(17)).

After the cutting, the cutter 60 is returned to its original position, and the tape extended from the roller pair 61 to the direction of the stacked banknotes M is pulled back to a position of the forward guide 62. On the other hand, the tape T on a side of the stacked banknotes M is traced to the end by the heater 59, and the tape T is heat-sealed up to the end (FIG. 2B(18)).

Thereafter, the heater 59 is restored to its original position (FIG. 2B(19)), and then, the upper and lower clamp arms 57 and 58 are kept apart in a direction separated from each other. Then, the bundling is completed (FIG. 2B(20)).

Subsequently, in order to remove the holder 63 holding the tape T from the tape T, the holding force of the holder 63 is released, and the holder 63 is displaced backwardly (in the direction vertically deeper relative to the paper). As a result, the holder 63 is separated from the tape T. The bundle of banknotes M that has been bundled by the bundling hand 70 sandwiching the bundled stacked banknotes M is guided to the bundle forward guide 64, and transported to the left direction (FIG. 2B(20)).

In addition, as described above, the bundled banknotes M may be passed over from the bundling hand 70 to the transporting hand 68 to be discharged to outside the housing 3. Also, the bundle of banknotes M may be optionally carried to a storage (not shown).

When two bundlings are performed on banknotes, the operation is as follows: the bundling hand 70 moves in the right direction while holding the stacked banknotes M bundled at one location by the bundling hand 70. Thereafter, the tape and accommodation for the stacked banknotes M are prepared as shown from FIG. 2A(1), where the bundle of banknotes held by the bundling hand 70 is put.

Thus, the series of bundling operations performed by the bundling mechanism 54 have been explained.

<Tape Setting Unit and Tape Switching Unit>

Subsequently, a configuration example of a tape setting unit 80 included in the bundling device 51 will be specifically explained.

Figure 3:
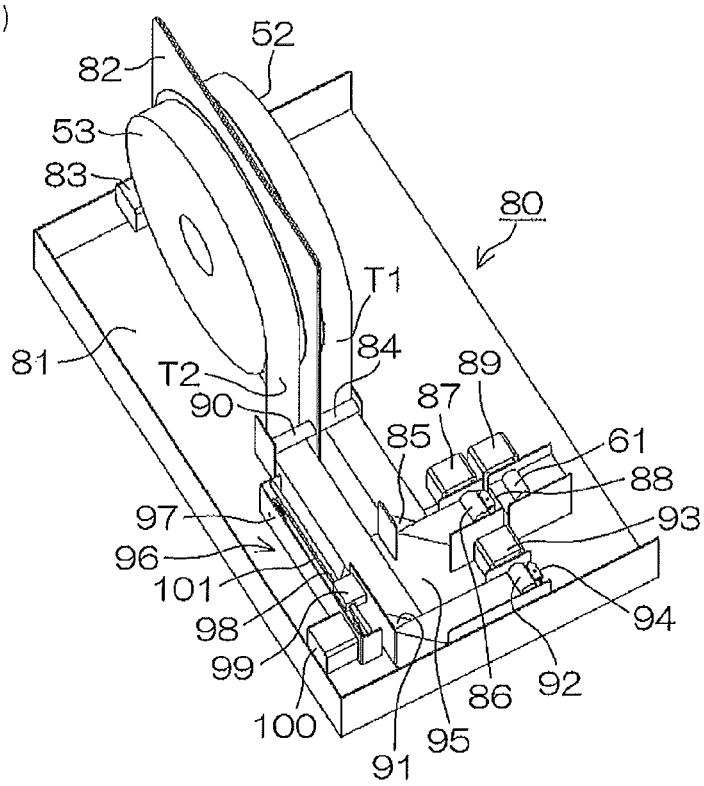
FIG. 3 A perspective view for describing one embodiment of the tape switching unit in the banknote handling apparatus according to one embodiment of the present invention.
Figure 3:
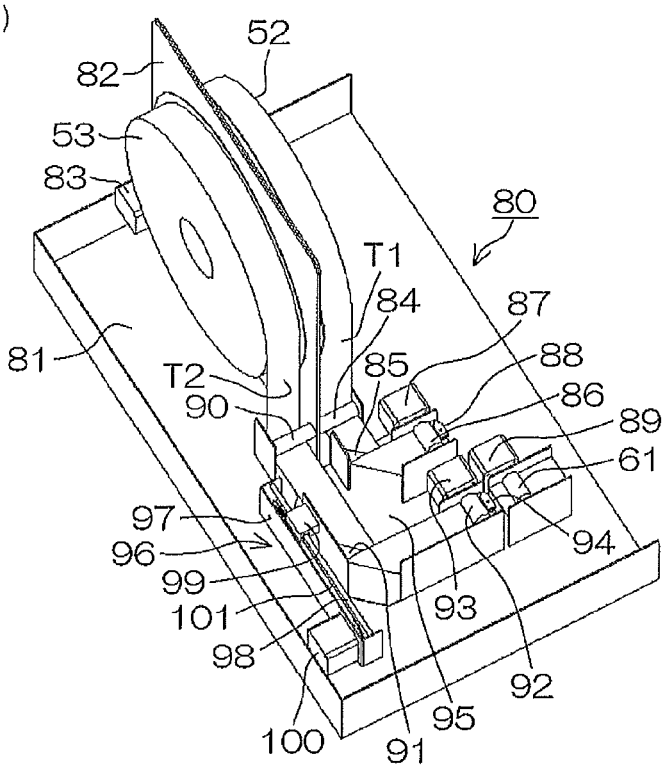

FIG. 3 is a perspective view, as seen from the rear side, of a configuration example of the tape setting unit 80 provided in the banknote handling apparatus 1 according to one embodiment of the present invention. FIG. 3(1) is a perspective view of a state where a tape T1 is fed from a tape reel 52, and FIG. 3(2) is a perspective view of a state where a tape T2 is fed from a tape reel 53.

With reference to FIGS. 3(1) and (2), the tape setting unit 80 includes a base plate 81. On the base plate 81, a reeled-tape setting plate 82 is erected on a substantial front portion of the base plate 81, for example. On both left and right sides of the reeled-tape setting plate 82, reeled tapes 52 and 53 are set so that each of the center shafts horizontally face right and left directions. In association with the reeled-tape setting plate 82, reel drive motors 83 are provided. In the drawings, although only the reel drive motor 83 for driving the reeled tape 53 is shown, the reel drive motor 83 for driving the reeled tape 52 is also provided. The reason for providing the reel drive motors 83 individually to the reeled tapes 52 and 53 is that each of the diameters (outer diameters) of the reeled tapes 52 and 53 changes as the reeled tapes 52 and 53 are selectively fed. This arrangement is made in consideration of the fact that unless the reeled tapes 52 and 53 are individually rotated, it is not possible to appropriately feed the tapes.

Moreover, the reason for placing the reeled tapes 52 and 53 on the front side is to facilitate the replacement of the reeled tapes 52 and 53. In addition, upon replacement of the reeled tapes 52 and 53, the base plate 81 is pulled out, and thus, a entire reel switching mechanism including the reeled tapes 52 and 53 is forwardly pulled out.

The tape T1 fed from the rotated reeled tape 52 is guided to an exit roller 84, then backwardly pulled out in the horizontal direction along the base plate 81, and guided to a diverting roller 85 by which the feeding direction of the tape T1 is horizontally changed to the right. Then, the tape T1 is clamped from above and below by a pulling-out roller pair 86 disposed on the path, and sent forth in the right direction.

The pulling-out roller pair 86 is driven by a tape-forwarding motor 87. On the exit side (on the right side in FIG. 3(1)) of the pulling-out roller pair 86, a tape sensor 88 for detecting the leading end of the tape to be pulled out from the pulling-out roller pair 86 is provided.

In FIG. 3(1), in order for the pulling-out roller pair 86 to receive the tape T1 that has been pulled out from the reeled tape 52, the roller pair 61 is positioned adjacent to the exit side of the pulling-out roller pair 86. The roller pair 61 is the roller pair arranged in the already-described bundling mechanism 54 (see FIG. 2A(1)). The rotation of the roller pair 61 is controlled by a dedicated tape-forwarding motor (stepping motor) 89.

In order to feed the tape T2 from the reeled tape 53, a similar mechanism is provided. The mechanism includes: an exit roller 90 for guiding the tape T2 (that is pulled out from the reeled tape 53) substantially horizontally backward along the base plate 81; a diverting roller 91 for changing an advancing direction of the tape T2 (that is guided by the exit roller 90 to be pulled out horizontally backward) by 90 degrees to the right; and a pulling-out roller pair 92 for pulling out the tape T2 of whose direction has been changed. The pulling-out roller pair 92 is arranged to be aligned with the pulling-out roller pair 86 for pulling out the reeled tape 52 on the same axis in the back-and-forth direction, positioned on a backward side of the pulling-out roller pair 86, and rotated by the dedicated tape-forwarding motor 93. Also on the exit side of the pulling-out roller pair 92, there is provided a tape sensor 94 for detecting the leading end of the tape T2 pulled out by the pulling-out roller pair 92.

In this embodiment, the diverting rollers 85 and 91, the pulling-out roller pairs 86 and 92, the tape-forwarding motors 87 and 93, and the tape sensors 88 and 94 are arranged on a common mounting base 95, and a shift mechanism 96 for permitting back-and-forth horizontal slide movement of the mounting base 95 is provided. The shift mechanism 96 includes a shaft 98 held by a frame 97 fixed to the base plate 81. The shaft 98 extends in parallel to and in a horizontal back-and-forth direction of the base plate 81. Moreover, a movement block 99 that moves in a horizontal back-and-forth direction as a result of being guided by the shaft 98 is provided. To the movement block 99, a drive chain 101 driven by a sliding motor 100 is connected. When the sliding motor 100 is rotated, the drive chain 101 moves. As a result, the movement block 99 connected to the drive chain 101 moves in a horizontal back-and-forth direction as a result of being guided by the shaft 98.

To the movement block 99, the mounting base 95 is linked. Along with the movement of the movement block 99, the mounting base 95 slides and moves in the horizontal back-and-forth direction.

With this configuration, when the rotation of the sliding motor 100 is controlled, it is possible to switch between: a state where the mounting base 95 is slid and moved in the horizontal back-and-forth direction so that the pulling-out roller pair 86 provided on the mounting base 95 faces the roller pair 61 (state in FIG. 3(1)); and a state where the pulling-out roller pair 92 faces the roller pair 61 (state in FIG. 3(2)). Therefore, it is possible to switch whether to feed the tape T1 of the reeled tape 52 or the tape T2 of the reeled tape 53.

Thus, in this embodiment, a switching unit for switching the tapes is configured by the shift mechanism 96.

The tape switching unit is configured to switch between, through the slide movement, the pulling-out roller pairs 86 and 92, the tape-forwarding motors 87 and 93, and the diverting rollers 85 and 91 for pulling out the tapes T1 and T2 from the reeled tapes 52 and 53 respectively, while retaining the reeled tapes 52 and 53 in a fixed state. Thereby, the mechanism for switching the tapes can be simple and reduced in size.

Particularly, in this embodiment, the pulling-out direction of the tapes T1 and T2 pulled out from the reeled tapes 52 and 53 is diverted by substantially 90 degrees by the diverting rollers 85 and 91, and thus, it is possible to successfully perform a tape switching operation in which the tapes are fed to the bundling mechanism 54 while the reeled tapes 52 and 53 themselves are retained in a fixed state.

In the embodiment shown in FIG. 3, the mechanism for selectively pulling out the tapes T1 and T2 from the reeled tapes 52 and 53 is described. Even in a case where there are at least three reeled tapes, if the diverting rollers, the pulling-out roller pairs, and the tape-forwarding motors are arranged for the respective reeled tapes, the same effect can be exhibited.

<Alternative Embodiment of the Tape Switching Unit>

Figure 4:
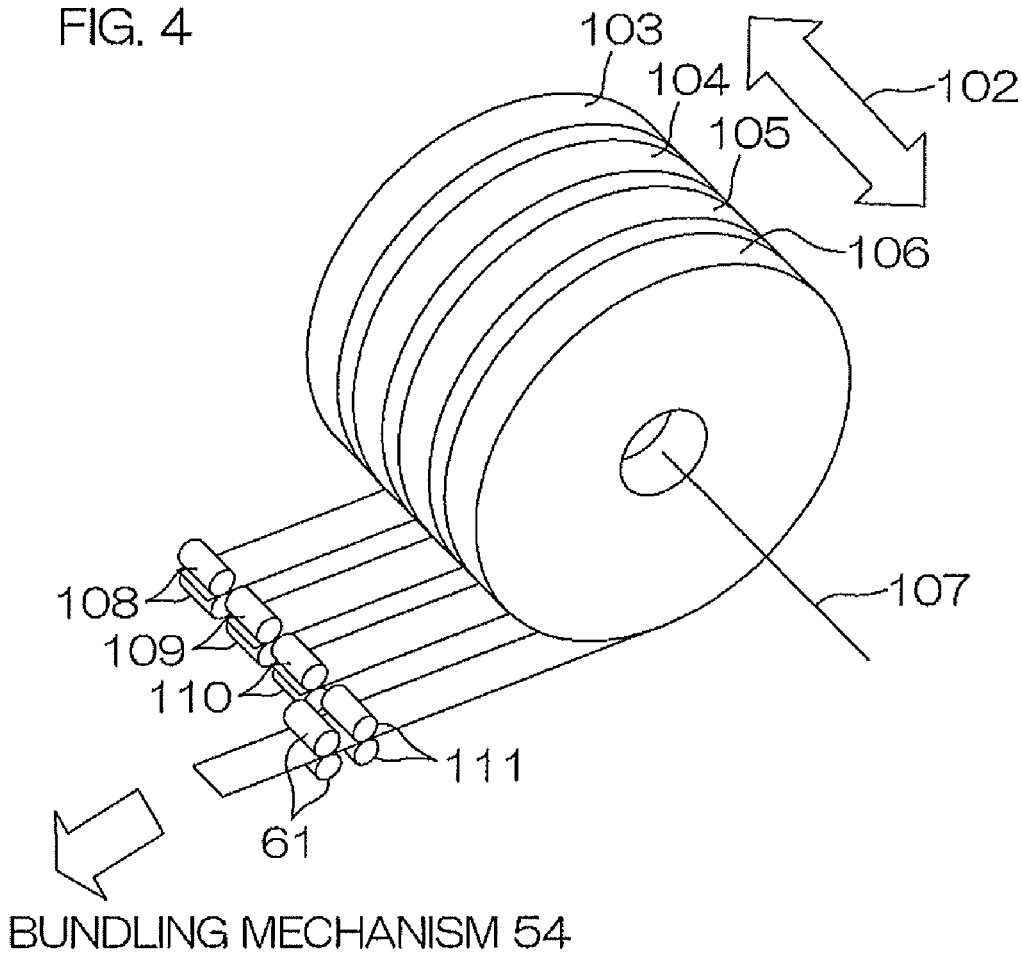
FIG. 4 A perspective view illustratively showing another configuration example of the tape switching unit applicable to the banknote handling apparatus according to one embodiment of the present invention.

FIG. 4 is a perspective view showing the overview of the configuration of tape switching unit according to an alternative embodiment of the present invention.

Tape switching unit 102 may be configured so that the entire plurality of reeled tapes to be disposed are integrally slid. More specifically, a plurality of reeled tapes 103, 104, 105, 106 . . . are disposed so that the center axis 107 are aligned on a horizontal straight line. Then, pulling-out roller pairs 108, 109, 110 and 111 individually arranged in the respective reeled tapes 103 to 106 are disposed in a common mounting member (not shown). The plurality of reeled tapes 103 to 106 and the respectively corresponding pulling-out roller pairs 108 to 111 are made to slide and move horizontally integrally in the direction of the axis 107.

With this configuration, any one of the pulling-out roller pairs 108 to 111 is able to be selectively faced the roller pair 61 of the bundling mechanism 54. Thus, a bundle of stacked banknotes can be bundled by using a desired tape.

In this case, however, the plurality of reeled tapes 103 to 106 are slid and moved. Even so, the tapes pulled out from the plurality of reeled tapes 103 to 106 are to be pulled out by the pulling-out roller pairs 108 to 111 disposed adjacently to the reeled tapes 103 to 106. That is, a large space is not necessary for the slide movement of the entire plurality of reeled tapes, which in turn enables a relatively compact configuration.

<Control Circuit Block>

Figure 5:
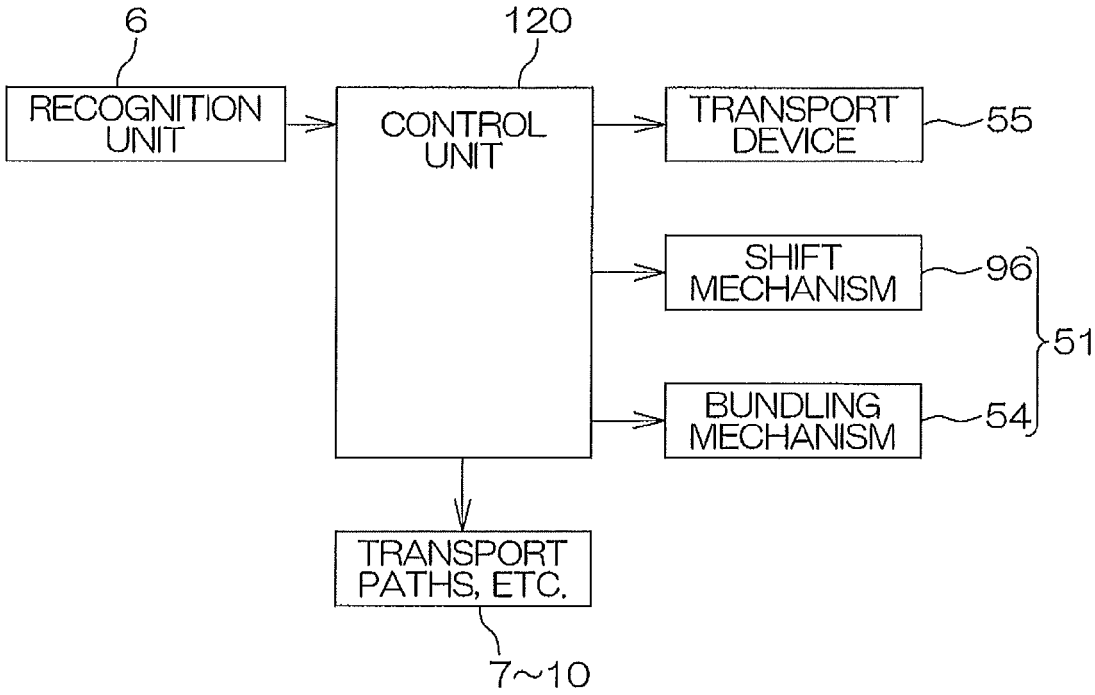
FIG. 5 A block diagram of a control circuit of the banknote handling apparatus according to one embodiment of the present invention, i.e., a block diagram showing only portions associated with features of the present invention.

FIG. 5 is a block diagram of a control circuit for executing a control operation, which is a feature of the banknote handling apparatus 1, and illustrates only a configuration necessary for this operation, which is the feature of the present invention.

The banknote handling apparatus 1 is provided with a control unit 120 configured by a microcomputer, etc. The control unit 120 controls a banknote transport along the transport paths 7 to 10, based on recognition information of the banknotes supplied from the recognition unit 6. Moreover, the control unit 120 controls the transport device 55 (see FIG. 1B) so that the banknotes stacked in the stacking units 32 to 36 are extracted and transported to the bundling mechanism 54. Moreover, the control unit 120 controls the bundling device 51. In the bundling device 51, the shift mechanism 96 (see FIG. 3) and the bundling mechanisms 54 (see FIG. 2A and FIG. 2B) are included. When the mechanisms 96 and 54 are controlled by the control unit 120, the stacked banknotes are bundled with a predetermined tape.

<Control Operation>

Subsequently, based on an example of an operation in a case where collected dollar banknotes are arranged by using the banknote handling apparatus 1 in a financial institution in the United States of America (hereinafter, "the USA"), the control operation of the banknote handling apparatus 1 will be explained.

In the financial institution in the USA, it is regulated that the collected banknotes are stacked in 100 sheets unit and bundled with a tape of a predetermined color. For example, 20-dollar banknotes are bundled in purple, 10-dollar banknotes in yellow, and 5-dollar banknotes in red.

Therefore, in the banknote handling apparatus 1 according to this embodiment, the transport paths 7 to 10, the transport device 55, and the bundling device 51 (the shift mechanism 96 and the bundling mechanism 54) are controlled by the control unit 120, as described below, so that the 20-dollar banknotes can be bundled effectively, for example.

Along with a flow in FIG. 6, the above will be explained with reference to FIGS. 1A, 1B, 3 and 5.

When the control unit 120 determines that a 20-dollar banknote is received based on the banknote information recognized by the recognition unit 6 (step S1), the stacking unit 32, for example, is set as the stacking unit for stacking this 20-dollar banknote (step S2). The diverters 18, 21, and 23 to 26 along the transport paths 7 to 10 are switched so that the recognized 20-dollar banknote is transported to the stacking unit 32, and further, the diverter 41 along the transport path 31 is switched so that the 20-dollar banknote is stacked in the stacking unit 32.

Then, it is determined that the number of 20-dollar banknotes stacked in the stacking unit 32 has reached 100 sheets (YES: at step S3), the control unit 120 drives the transport device 55 so that the 100 sheets of 20-dollar banknotes stacked in the stacking unit 32 are transported to the bundling mechanism 54 (step S4).

Figure 6:
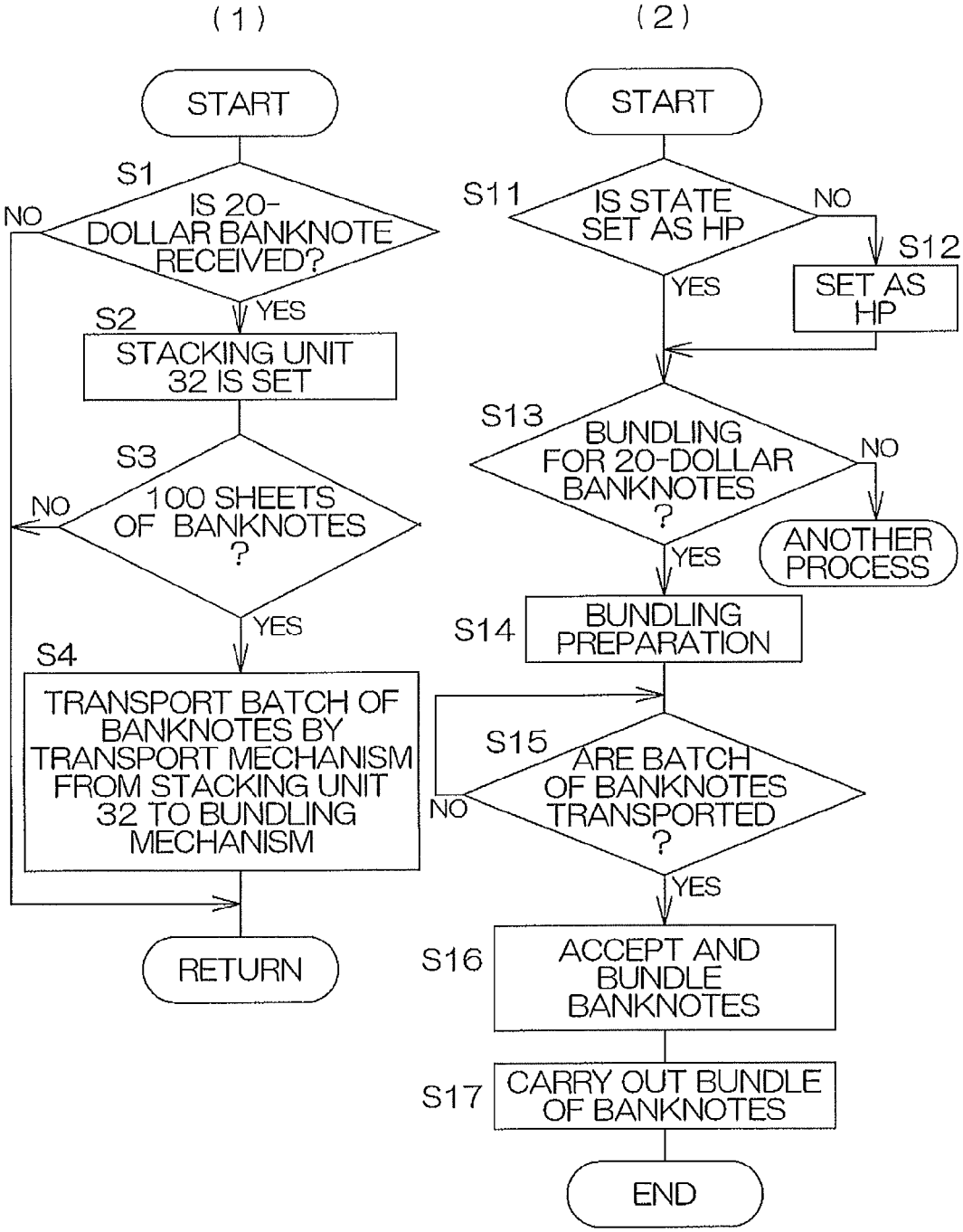
FIG. 6 A diagram showing one example of a flowchart of a control operation for switching tapes performed in a control unit shown in FIG. 5.

In parallel to the above-described control in FIG. 6(1), the control unit 120 controls the bundling device 51 as shown in FIG. 6(2).

First, the control unit 120 determines whether the tape T1 on the reeled tape 52 is fed to the bundling mechanism 54 in the tape setting unit 80 (step S11). In this embodiment, a state where the tape T1 on the reeled tape 52 is fed is set as a home position (HP), and the tape to be normally fed is set as the tape T1 on the reeled tape 52.

For this reason, if the tape setting unit 80 is not at the home position, i.e., if the tape setting unit 80 is in the state where the tape T2 on the reeled tape 53 is to be fed to the transport mechanism 54, as shown in FIG. 3(2), then the control unit 120 switches the tape setting unit 80 from a state in FIG. 3(2) to that in FIG. 3(1) (step S12).

The switching to the home position is performed by sliding and moving the entire mounting base 95 by the shift mechanism 96 so as to displace the pulling-out roller pair 86 to the position to face the roller pair 61.

At step S11, it is determined whether or not the tape setting unit 80 is at the home position. If the tape setting unit 80 is not at the home position, the tape setting unit 80 will be set on the home position at step S12. Thus, the tape to be fed for bundling is set as the tape for bundling the predetermined 20-dollar banknote, which results in a smooth start of the bundling process.

Subsequently, the control unit 120 checks whether to bundle the 20-dollar banknotes (step S13). Ina case of bundling the 20-dollar bank notes, the control unit 120 drives the bundling mechanism 54 so that a bundling preparation is performed (step S14). Then, when the 100 sheets of 20-dollar banknotes are transported by the transport device 55 (step S15), the control unit 120 causes the bundling mechanism 54 to accept these banknotes to perform the bundling process (step S16). Then, a bundle of the bundled banknotes is carried out (step S17).

This embodiment is configured so that two reeled tapes 52 and 53, in other words, reeled tapes equal in number to the kinds of banknotes to be bundled, can be set in the tape setting unit 80, as shown in FIG. 3, for example. In a case where only two reeled tapes can be set in this way, if the banknotes to be bundled are limited to the 20-dollar banknotes, then the two reeled tapes may be reeled tapes for 20-dollar banknotes of the same kind.

On the other hand, as shown in FIG. 4, in a case where at least three reeled tapes can be set, the following may be possible: two or three (a plurality of) reeled tapes for frequently used banknotes, e.g., 20-dollar banknotes, are set, and only one infrequently used reeled tape is set.

In this case, if the home position of the tape setting unit is set so that the frequently used reeled tapes are always at a feeding position, this enables smoothly feeding the frequently used tapes and realizing a prompt bundling process.

When the tape setting unit 80 is at the home position, an arrangement structure for easily replaced the reeled tapes to be fed may be adopted (for example, the reeled tapes at the home position are brought close to a near side when the tapes are pulled out at the time of tape replacement), then the apparatus may have a structure where the frequently used reeled tapes can be easily replaced. With this configuration, it is possible to realize a banknote handling apparatus enabling an easy tape replacement.

The above-described embodiments are configured so that the color of the tape to be bundled is changed according to a value (denomination) of the banknote. However, for example, it may be optionally possible to configure that depending not on a denomination but on fitness, the colors of the tapes for bundling are switched. More specifically, it may be optionally possible to configure to switch the colors of the tapes for bundling depending either on a banknote having a small amount of contamination or wrinkle, i.e., the fit banknote, or a banknote having a large amount of contamination or wrinkle, i.e., the unfit banknote. For example, the fit banknote is bundled with a white-colored tape and the unfit banknote is bundled with a red-colored tape.

Moreover, it is recognized whether the banknotes are counterfeit or genuine, and then according to the recognition result, the colors of the bundling tape may be optionally switched. For example, the counterfeit banknotes may be bundled with a black-colored tape and the genuine banknotes may be bundled with a white-colored tape.

Moreover, it is also possible to recognize and bundle banknotes of a plurality of countries. For example, banknotes of a plurality of countries may be sorted by each country, and tapes are switched so that the banknotes are bundled with tapes different in color depending on each country.

The present invention exhibits the effect that if the bundling tapes are switched, distinguishing the kinds of bundles of banknotes at first sight by observing the color of the tape that bundles the bundle of banknotes is enabled.

The present invention is not limited to the embodiments explained above, and can be modified in various ways within the scope of the claims.

The invention claimed is:

1. A banknote handling apparatus for handling banknotes, comprising:

a recognition unit configured to recognize a kind of banknote;

a stacking unit configured to stack a banknote of a predetermined kind recognized by the recognition unit; and a bundling unit configured to bundle the banknotes stacked by the stacking unit, the bundling unit including:

a tape setting unit configured to set a plurality of reeled tapes;

a bundling mechanism configured to bundle the stacked banknotes by using a tape pulled out from any one of the reeled tapes set in the tape setting unit; and a tape selecting unit configured to select a tape from the tapes set in the tape setting unit based on banknote information recognized by the recognition unit; and a tape switching and feeding unit configured to switch the tape selected by the tape selecting unit and to feed it to the bundling mechanism from the tape setting unit.

2. The banknote handling apparatus according to claim 1, wherein the tape switching and feeding unit includes:

a plurality of tape-feeding mechanisms configured to receive the respective reeled tapes set in the tape setting unit; and a shift mechanism configured to integrally slide and move the plurality of tape-feeding mechanisms so that any one of the tape-feeding mechanisms faces the bundling mechanism.

3. The banknote handling apparatus according to claim 2, wherein each of the plurality of tape-feeding mechanisms has a diversion path along which a feeding direction of the tape fed from the reeled tape is diverted by substantially 90 degrees.

4. The banknote handling apparatus according to claim 3, wherein a plurality of reeled tapes of the same kind are set in the tape setting unit to bundle the predetermined kind of banknotes, out of the banknotes to be bundled by the bundling unit.

5. The banknote handling apparatus according to claim 4, wherein the tape for bundling the predetermined kind of banknotes is always positioned to be fed to the bundling mechanism.

6. The banknote handling apparatus according to claim 2, wherein the shift mechanism integrally slides the tape setting unit and the plurality of tape-feeding mechanisms.

7. The banknote handling apparatus according to claim 6, wherein a plurality of reeled tapes of the same kind are set in the tape setting unit to bundle the predetermined kind of banknotes, out of the banknotes to be bundled by the bundling unit.

8. The banknote handling apparatus according to claim 7, wherein the tape for bundling the predetermined kind of banknotes is always positioned to be fed to the bundling mechanism.

9. The banknote handling apparatus according to claim 2, wherein a plurality of reeled tapes of the same kind are set in the tape setting unit to bundle the predetermined kind of banknotes, out of the banknotes to be bundled by the bundling unit.

10. The banknote handling apparatus according to claim 9, wherein the tape for bundling the predetermined kind of banknotes is always positioned to be fed to the bundling mechanism.

11. The banknote handling apparatus according to claim 1, wherein a plurality of reeled tapes of the same kind are set in the tape setting unit to bundle the predetermined kind of banknotes, out of the banknotes to be bundled by the bundling unit.

12. The banknote handling apparatus according to claim 11, wherein the tape for bundling the predetermined kind of banknotes is always positioned to be fed to the bundling mechanism.

* * * * *